United States Patent [19]

Wain

[11] 4,335,809

[45] Jun. 22, 1982

[54] ENTERTAINMENT MACHINES

[75] Inventor: John L. Wain, Cheadle Hulme, England

[73] Assignee: Barcrest Limited, Ashton-under-Lyne, England

[21] Appl. No.: 116,627

[22] Filed: Jan. 29, 1980

[30] Foreign Application Priority Data

Feb. 13, 1979 [GB] United Kingdom ..... 7905068

[51] Int. Cl.[3] ..... G07F 13/34

[52] U.S. Cl. ..... 194/1 R; 194/DIG. 11; 273/138 A; 364/200; 364/900

[58] Field of Search ..... 194/1 R, 1 N, DIG. 11; 364/200 MS File, 900 MS File; 273/138 A

[56] References Cited

U.S. PATENT DOCUMENTS 3,641,536 2/1972 Prosprich ..... 222/23

3,688,276 8/1972 Quinn ..... 364/200 MS File 3,927,800 12/1975 Zinsmeyer et al. ..... 222/26

FOREIGN PATENT DOCUMENTS 1466765 3/1977 United Kingdom ..... 194/DIG. 11

1545301 5/1979 United Kingdom ..... 194/DIG. 11

*Primary Examiner*—Joseph J. Rolla

[57] ABSTRACT

A coin-freed player-operable entertainment machine is connected via a transmission link, such as a telephone line, to a remote control device. The link may be used to tramsmit program information to a control system of the machine so that the game to be played with the machine can be changed as desired from the remote control location. Alternatively or additionally, the transmission link may be used to transmit information concerning machine operation from the machine to the remote control location.

9 Claims, 2 Drawing Figures

ENTERTAINMENT MACHINES

Figure 1:
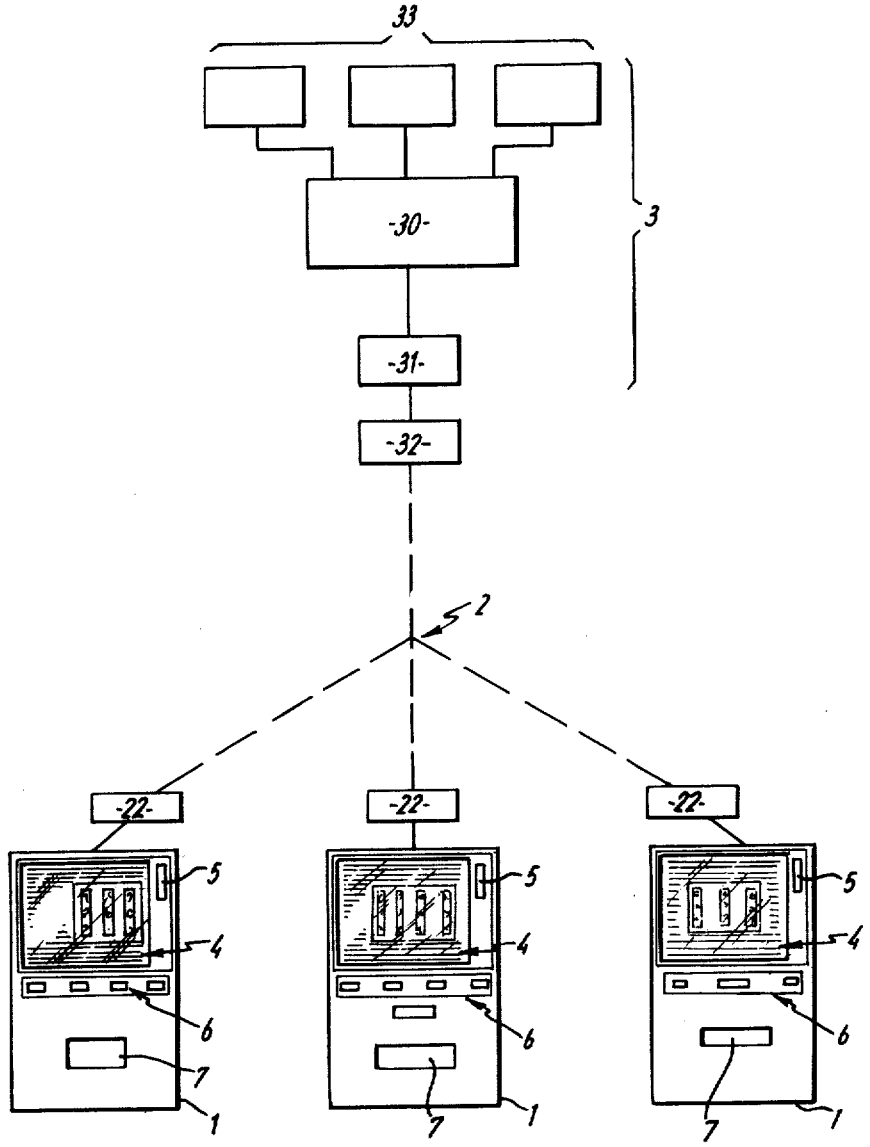

This invention relates to entertainment machines including both gaming machines and non-gaming amusement machines of the kind, hereinafter referred to as the kind defined, which is operable by a player, after actuation of the machine by insertion of one or more coins or tokens into an appropriate coin mechanism of the machine, so as to perform a number of operations (particularly although not necessarily on a random basis) as initiated by the player, and to perform further operations determined by the first said operations (involving, for example, the actuation of a device which gives a win indication in the event that a predetermined arrangement such as a predetermined combination or sequence of the first said operation is achieved).

In our British Pat. No. 1,545,301 there is described an entertainment machine of the kind defined which incorporates a control system arranged to respond to and effect control of machine operations, wherein said control system incorporates a processing device, and a plurality of interchangeable program devices are provided for individual detachable incorporation in the control system for feeding different respective program information to the processing device corresponding respectively to adaptation of the machine for the playing of different games therewith, whereby the machine can be adapted for playing a selected such game by selection of the pertaining said program device for said incorporation in the control system.

More specifically, said prior patent describes such a control system in which the processing device is in the form of a microprocessor unit (MPU) in the context of an entertainment machine of the fruit machine type, that is, a machine having a number of rotatable members such as drums or discs carrying symbols or indicia, which members are in play set in rotation and subsequently come to rest with a combination of said indicia displayed to the player, the duration of rotation of each member, and hence the displayed combination of indicia being determined wholly or largely on a random basis and a reward mechanism being actuated in the event that said displayed combination is of a predetermined nature. Reference is made to the specification of said British Pat. No. 1,545,301 for further details of the entertainment machine the subject thereof.

In our co-pending British application No. 24720/78 (to which published European patent application No. 0005930 corresponds) there is described an improvement in or modification of the entertainment machine the subject of the aforesaid British Pat. No. 1,545,301. Said application No. 24720/78 discloses an entertainment machine which can be operated by a player, after actuation of the machine by insertion of one or more coins or tokens into a coin mechanism of the machine, to initiate performance of first machine operations represented by a visual display of a moving or changing nature terminating at random in a fixed visual display, said machine being arranged to perform further operations resulting in a win indication in the event that said fixed display is of a predetermined nature, and said machine incorporating a control system arranged to respond to and effect control of said machine operations, the control system incorporating a processing device and a program device incorporated in the control system for feeding program information to the processing device, said program device being adapted to be changed for changing the nature of said program information so that the machine can be adapted for the playing of different games therewith, characterised in that the machine has an electronic visual display unit having a front screen arranged to produce said visual displays thereon, and said visual display unit is connected to the said control system so that production of said displays thereon is arranged to be controlled by the control system in accordance with the program information provided by the program device selected for incorporation in the system. As further described in the said application, by replacing or modifying the program device of the control system, the display can be changed so that for example a display simulating rotatable drums or discs and other features of a fruit machine may be modified or substituted by a display simulating features of a different kind of entertainment machine. Reference is made to the specification of said application No. 24720/78 (and the corresponding European application) for further details of the entertainment machine the subject thereof.

With the said entertainment machines of the said patent and co-pending application, manufacture of different machines for playing different games and also modification of existing machines to change or modify the games to be played therewith can be effected in a particularly simple, convenient and inexpensive manner in so far as different games can be selected simply by appropriate selection of different program information produced by the program devices of the machines and other parts of the machines may be standardised. Accordingly, with said entertainment machines, it is possible in a simple, convenient and inexpensive manner to vary frequently the game which can be played at a particular machine site (which may be club premises, licensed premises, or the like) by frequent replacement or modification of the machine at such site, this facility being extremely advantageous in so far as use of such machines, and consequently the amount of money taken with same, tends to reduce as players become familiar with the games played therewith.

However, it will be appreciated that such replacement or modification of machines involves transport of machines to and from the sites and/or requires visits of personnel to the sites, and requires the services of an appreciable number of skilled or semi-skilled personnel to perform said manufacture or modification. It may therefore not be possible or convenient to effect variation of the game which can be played at a particular site as and when desired or with relatively great frequency.

An object of the present invention is to provide an entertainment machine of the kind described with which it is possible in a convenient manner to vary the game which can be played therewith, as and when desired and even in the case where it is desired to effect said variation with relatively great frequency.

According to one aspect of the present invention therefore there is provided a machine system comprising at least one entertainment machine of the kind defined having a control system arranged to respond to and effect control of machine operations, said control system incorporating a processing device and a program device for feeding program information to the processing device, and a main control device remote from the or each said machine and connectable to said control system thereof via a remote transmission link, said main control device being operable to vary the said program information fed by the program device to the processing device of the or each machine by transmission of signals via said link to said control system.

With this arrangement it will be appreciated that the game played with a machine at a particular machine site can be varied from a location remote thereto and without requiring said machine to be removed or personnel to visit said site, whereby it may be convenient to effect said variation as and when desired and with relatively great frequency.

With regard to the nature of the machine, preferably this is of the fruit machine type as hereinbefore explained. Also, the machine is preferably a machine of the kind described in either one or both of the aforementioned patent and co-pending application. However, if desired, other types of entertainment machines of the kind defined may be utilised.

Most conveniently, the main control device may be connected to a plurality of said entertainment machines, whereby all machines can be controlled independently or simultaneously by the same said control device. The main control device may be at a central location and the machines may be at a plurality of different remote machine sites. Where the machines are independently controlled an appropriate coding or selection system may be provided to enable such independent control to be effected via a common transmission link; or, alternatively, separate transmission links may be provided. The machines may be all different or of one or more common kinds as desired.

With regard to the or each transmission link, this is preferably a cable link and conveniently existing cable systems such as lines of a public or private telephone system or the like may be utilised. Alternatively, if desired, a radio wave or other electromagnetic radiation link may be used.

Most preferably, the control system of the or each machine incorporates a memory device of the kind which can store program information fed thereto from the main control device and can subsequently be readily erased to enable fresh information to be stored. Thus a memory device of the kind shown as a Random Access Memory (RAM) may be used. Preferably, also, the memory device is such that information stored therein cannot be readily erased deliberately or inadvertently by mis-use of or tampering with the machine. Thus, the device should preferably be such that stored information can be retained even when the machine is disconnected from a main power supply therefor. This may be achieved by using a memory-retaining device or by providing the device with an independent power supply. Thus a lower power consumption RAM (a CMOS RAM) powered by a rechargeable battery charged from the main power supply may be used.

With the entertainment machines of the aforesaid prior patent and application it is also necessary or desirable for personnel to visit the machine sites to perform repair or maintenance work and to check machine information relating to use thereof and possibly also to collect money therefrom. A further object of the invention is to provide a machine system with which such visits can be eliminated or at least appreciably reduced.

According to a second aspect of the present invention therefore there is provided a machine system comprising at least one entertainment machine of the kind defined having means for producing electrical signals representing information concerning operation of the machine, and a main control device remote from the said machine and connectable to said machine via a remote transmission link, said main control being operable to receive said signals from said machine via said link.

With this arrangement it will be appreciated that it is possible to receive information remote from the or each machine relating to, for example, the operational state of such machine, the frequency of use thereof and the amount of money taken with same. Information-collecting visits to the or each machine site can therefore be obviated or at least appreciably reduced. In the case where information as to the amount of money taken is obtained via the remote transmission link, it is feasible and convenient to allow personnel already employed in the vicinity of the machine site (such as the manager or owner of club premises, licensed premises, a bar or the like) to collect and bank the money from the machine.

Our prior British Pat. No. 1,542,284 describes an entertainment machine with which signals representing information relating to machine operation are produced at a machine connection means and reference is made to the specification of such patent for further details thereof, which details may apply, appropriately adapted where necessary, to the machine of the present invention. More specifically, British Pat. No. 1,542,284 describes the use of a plug-in recording module which interfaces with electrical components of the entertainment machine and which contains solid state recording devices such as electronic counters and latching circuits. When the module is plugged into the machine, information relating to machine operation (e.g. information as to games played, coins received, coins paid out) is fed to the module (e.g. as electrical signals derived from pay-out solenoids, coin mechanisms, electromagnetic machine counters) and such information is recorded in the module. Also, fixed code signal combinations (e.g. identifying machine type and machine site) are fed to the module and recorded therein. In accordance with the second aspect of the present invention such information, code signals and the like may be generated in like manner to British Pat. No. 1,542,284 and may be fed to a storage device (e.g. in a form identical with or similar to the module of British Pat. No. 1,542,284 or alternatively (and after appropriate processing) in the form of a RAM or like binary memory) so as to be recoverable for transmission via said remote transmission link on demand, appropriate circuitry being provided to interface such storage device with the link and to control feed of stored data along the link.

With regard to the nature of the or each machine and the transmission link with the second aspect of the invention, these may be as described above in relation to the first aspect of the invention.

The transmission link of the second aspect of the present invention may be two-way or may be accompanied by an opposite direction transmission link whereby control signals may be transmitted to the or each machine as a consequence of the signals received from the machine. Thus, for example, the first and second aspects of the invention may be combined and the program information of the or each machine may be varied to change or modify the game played therewith in the event that signals from the machine indicate that the machine is not being frequently used. Alternatively or additionally the or each machine may be deactuated and/or visual and/or audible warning devices or instruction devices may be operated on or in the vicinity of the machine in the event that signals from the machine indicate that the machine is faulty or is being tampered with.

With regard to the said main control device for the first and/or second aspects of the invention, this may involve a processing system or computer with associated apparatus which is capable of feeding signals to the or each said transmission link in a form suited to transmission of the requisite information to the or each machine and/or which is capable of receiving signals from the or each machine via the or each transmission link and appropriately interpreting same.

Figure 2:
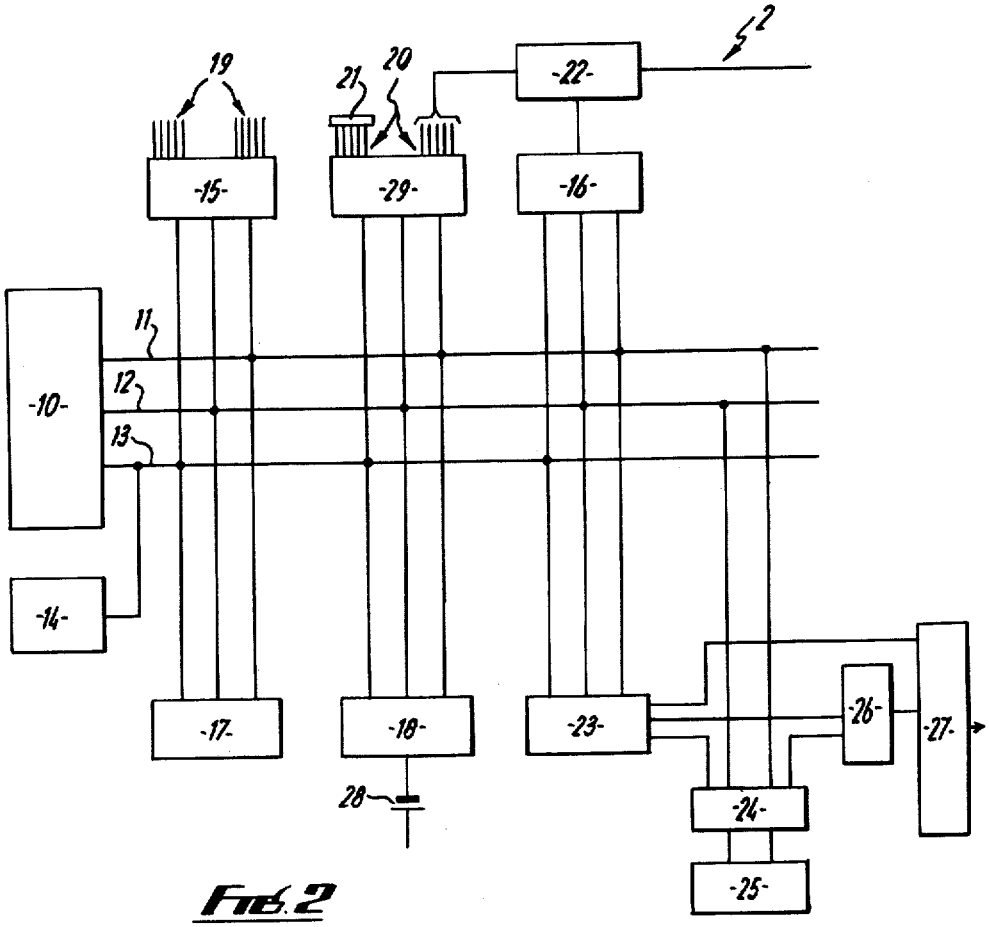

The invention will now be described further by way of example only and with reference to the accompanying drawings in which:

FIG. 1 is a diagrammatic representation of one kind of a machine system according to the present invention; and FIG. 2 is a schematic circuit diagram showing components of a control system of one machine of the system of FIG. 1.

The machine system comprises a plurality of entertainment machines 1 at a plurality of different sites which may be clubs, bars, public houses or the like. The machines 1 are connected via telephone lines 2 to a main control device 3 at a central control location remote from the machine sites.

Each machine 1 comprises a floor-standing box-structure housing containing a colour video tube the front screen 4 of which is exposed through an opening in a front wall of the housing. A conventional coin mechanism has a slot 5 which is mounted at the front of the housing as also are control switches 6 and a pay-out chute 7. Inside the housing there is a control system which is connected to the coin mechanism, to the switches 6, to the video tube and to other mechanisms such as indicator lamps, game counters, coin counters, pay-out solenoids and the like.

As shown in FIG. 2, the control system comprises a main sequential processing device, namely a microprocessor unit (MPU) 10, having terminals connected to the usual address, data and control buses 11, 12, 13. Via these buses, the MPU is connected to auxiliary devices 14 such as a power supply, clock device and the like; peripheral interface adaptor (PIA) 15; an asynchronous communications interface adaptor (ACIA) 16; read-only memory (ROM) and/or programmable read-only memory (PROM) devices 17; and random access memory (RAM) devices 18.

One PIA device 15 has multiple input/output terminals 19 which are connected to switching triacs which control switching of heavy duty components such as pay-out solenoids, to switching transistors which control switching of indicator lamps, and to input switches such as coin mechanisms and player control switches. The other PIA device 15 has multiple input/output terminals 20 which are connected to a connector 21 and to a modulator-demodulator (MODEM) device 22 in the entertainment machine as will be described in greater detail hereinafter.

The MPU buses 11, 12, 13 are further connected to various cathode ray tube controlling devices including a cathode ray tube controller integrated circuit device (CRTC) 23, a multiplexer 24, a display random access memory (RAM) 25 and a character generator 26. These devices are connected to the video tube 4 via video interface circuitry 27 and are arranged to feed signals to the tube under the control of the MPU 10 to produce an appropriate display on the video tube screen, as determined by the program information in the ROM/PROM and RAM devices 17, 18. Such display may simulate the rotatable drums or discs of a conventional fruit machine and also may provide the decorative designs, information concerning the mode of play and awards, and other matter such as is usually printed on a front panel of a conventional fruit machine. For a more detailed description of the manner in which the cathode ray tube display is produced, reference is made to the specification of our co-pending application No. 24720/78 (and corresponding European application No. 0005930).

The ROM/PROM devices 17 contain basic system control information (software) which is the same for a range of different kinds of games to be played with the machine. The RAM device 18 contains system control information (software) specific to one particular kind of game. The RAM device can store information reliably yet such information can be readily erased and fresh information stored therein as and when desired. In order to ensure reliable information storage the device is a low power consumption complementary metal oxide semi-conductor field effect transistor (CMOS) device and is powered by its own battery 28, which battery is a chargeable accumulator connected to the main machine power supply so as to be maintained in a fully charged state thereby when the machine power supply is switched on. Erasing of stored information and recording of fresh information is effected, under the control of the MPU, by signals obtained from the modem unit 22 via the serial interface unit (ACIA) 16.

The modem unit 22 is connected via the pertaining telephone line 2 to the central control device 3.

The central control device comprises a computer 30 with associated equipment comprising for example an output signal generator 31 connected via a modem unit 32 to the telephone line 2, and a keyboard/VDU/-printer 33, or other input/output system.

With the arrangement so far described, the RAM 18 of each machine is fed with program information from the main control device 3 appropriate to a particular game. Such information, and hence the game in question, may be the same or different for the different machines.

In the event that it is desired to change or modify the RAM information and hence the game, of any machine, appropriate control signals are fed from the main control device 3 to such machine. Such change or modification may be instigated automatically after an appropriate time interval or may be instigated when the rate of use of the machine falls to an unacceptable level.

Transmission of serial signals from the control device 3 to the machines is effected via the modems 32, 22 in conventional manner. That is, serial signals produced by the generator 31 under the control of the computer 30 are fed to the modem 32 where they are modulated to produce audio frequency tones suitable for transmission through the telephone system. By virtue of an automatic dialling system controlled by the computer 30, the modulated tones are fed along the lines 2 to a selected one of the modems 22. At such modem 22, the received tones are demodulated to produce serial signals suitable for feed to the pertaining ACIA 16.

Monitoring of machine operations, for example, to check rate of use thereof, to check takings, to monitor correct operation of same, may also be effected at the central control location by information signals fed back along the telephone line 2 to the computer 30. For this purpose, the ACIA 16 and modems 22, 32 are used in reverse manner to that described above. That is, signals representing machine operation information are generated and may be fed for example via the PIA 15 to be stored in RAM 18, such stored information being fixed or updated as appropriate. The stored information is fed to the computer 30 for interpretation via the ACIA 16 and the modems 22, 32, such feed occurring for example in response to a request transmitted from the control device 3 to the pertaining machine. Reference is made to the specification of our British Pat. No. 1,542,284 for a detailed description of the generation of signals representing machine operation information.

It will therefore be appreciated that the machines 1 can be monitored and the games to be played therewith can be changed as and when required and as frequently as desired all without necessitating visits by personnel to the machine sites. Visits will only be required when repair or maintenance work is needed. It is not even necessary for personnel to visit machine sites to collect takings therefrom. The amount of such takings is monitored at the central location and personnel already employed at the machine sites can collect and bank the money.

The operation of the modem 22 of each machine is controlled by output signals from the terminals 20 of the PIA 29. If desired, provision may be made for connection of a keyboard to each machine to enable a person at the machine site to communicate with the computer at the central location for the purpose of providing information requesting assistance or the like, and such connection may be effected via the connector 21 of the PIA 29.

It is of course to be understood that the invention is not intended to be restricted to the details of the above embodiment which are described by way of example only.

Thus, for example, the program information fed via said remote transmission link may relate to two or more games and provision may be made for the machine to operate in accordance with a selected one of such games as selected by the player (by operation of appropriate selection means) or as selected at random or on a predetermined basis by an automatic machine selection system or as selected by a signal transmitted along the remote transmission link.

Further, whilst reference is made herein to the use of a telephone cable link, it is to be understood that other telephone links such as optical fibre or microwave may be used. Also, a purpose-built transmission link system, rather than a telephone link system, involving cables, optical fibres, radiation or the like, may be used.

I claim:

1. An entertainment machine system comprising at least one entertainment machine and a main control device remote from said machine and connectable thereto via a remote transmission link;

said entertainment machine being of the kind which is operable by a player, after actuation of a coin or token mechanism of the machine, so as to perform a number of operations as initiated by the player and to perform further operations determined by the first said operations in accordance with a predetermined game to be played with the machine;

said entertainment machine having a control system which is arranged to respond to and effect control of said machine operations and which incorporates a processing device, and a program device containing stored program data determining the said game and operable to supply said data to the processing device;

said main control device being operable on occasions to transmit data signals via said link to said control system corresponding to different said stored program data for different said predetermined games;

the said control system further incorporating interface means connected to said program device and operable to receive said transmitted data signals, said control system being adapted to change the stored program data of said program device to different stored program data corresponding to said received data signals thereby to reprogram the machine for the playing of a different said game therewith.

2. A machine system according to claim 1, wherein the entertainment machine is a fruit machine having a number of rotatable members carrying indicia, which members are in play set in rotation and subsequently come to rest with a combination of said indicia displayed to the player, the duration of rotation of each member, and hence the displayed combination of indicia being determined wholly or largely on a random basis and a reward mechanism being actuated in the event that said displayed combination is of a predetermined nature.

3. A machine system according to claim 1, wherein the said transmission link is a cable link provided by lines of a telephone system.

4. A machine system according to claim 1, wherein the control system of the entertainment machine incorporates an erasable memory which is a CMOS RAM provided with the independent battery power supply.

5. A machine system according to claim 1, wherein the machine has an electronic visual display unit arranged to produce a visual display representative of the performance of the first said machine operations, said display unit being connected to said control system and production of said display being arranged to be controlled by said control system.

6. A machine system according to claim 5, wherein the said visual display is arranged to simulate rotatable members of a fruit machine.

7. A machine system according to claim 6, wherein the said visual display unit is also arranged to produce a visual display, under the control of said control system, of informative matter.

8. An entertainment machine system comprising a plurality of entertainment machines, a common main control device remote from said machines and adapted for connection thereto via respective remote cable transmission links;

each said entertainment machine being of the kind which is operable by a player, after actuation of a coin or token mechanism of the machine, so as to perform a number of operations as initiated by the player and to perform further operations determined by the first said operations in accordance with a predetermined game to be played with the machine;

each said entertainment machine having a control system arranged to respond to and effect control of said machine operations, said control system incorporating a processing device, a program device containing stored program data determining the said game and operable to supply said data to the processing device, and a modem device connected to said processing and program devices and adapted for connection to the respective said cable link;

said common main control device being operable on occasions to transmit fresh said program data corresponding to fresh said predetermined games via said links to the modems of the different said machines, and said control systems being operable to effect replacement of the stored data of the program devices under the control of the processing devices with said fresh program data thereby to reprogram the machine for the playing of said fresh games therewith.

9. A system according to claim 8, wherein each said machine also has means operable to produce electrical signals from said machines via said links.

* * * * *